US006921135B2

(12) United States Patent
Ellis et al.

(10) Patent No.: US 6,921,135 B2
(45) Date of Patent: Jul. 26, 2005

(54) CHILD'S ADJUSTABLE CHAIR

(76) Inventors: Craig Ellis, 224 Riverland Dr., Charleston, SC (US) 29412; Darcy M. Jones, 202 Nantucket Dr., Summerville, SC (US) 29485

( * ) Notice: Subject to any disclaimer, the term of this patent is extended or adjusted under 35 U.S.C. 154(b) by 0 days.

(21) Appl. No.: 10/654,296

(22) Filed: Sep. 3, 2003

(65) Prior Publication Data

US 2004/0041453 A1 Mar. 4, 2004

Related U.S. Application Data

(60) Provisional application No. 60/408,128, filed on Sep. 4, 2002.

(51) Int. Cl.[7] ..... A47C 1/02; A47C 1/06; A47C 1/12

(52) U.S. Cl. ..... 297/344.18; 297/353; 297/423.38; 297/423.44; 297/440.14; 297/400.15; 297/440.2; 297/440.22; 297/440.24; 297/445.1

(58) Field of Search ..... 297/344.18, 353, 297/440.15, 440.24, 440.14, 440.2, 440.22, 445.1, 423.38, 423.44

(56) References Cited

U.S. PATENT DOCUMENTS

| | | | | | |
|---|---|---|---|---|---|
| 315,779 | A | * | 4/1885 | Haynes | 297/423.38 X |
| 1,437,630 | A | * | 12/1922 | Zimmerli | 297/353 |
| 1,465,291 | A | * | 8/1923 | Walker | 297/423.38 X |
| 2,073,065 | A | * | 3/1937 | Kahn | 297/423.38 |
| 2,083,053 | A | * | 6/1937 | Collins | 297/423.38 X |
| 2,577,050 | A | * | 12/1951 | Van Buren | 297/353 X |
| 2,687,166 | A | * | 8/1954 | Hamilton | 297/353 X |
| 2,784,769 | A | * | 3/1957 | Fisher | 297/440.15 X |
| 3,858,935 | A | * | 1/1975 | Pask | 297/353 |
| 5,542,743 | A | * | 8/1996 | Olson et al. | 297/353 |
| 5,845,962 | A | * | 12/1998 | Lin | 297/440.24 X |
| 6,122,776 | A | * | 9/2000 | Cheng | 297/440.24 X |
| 2003/0102700 | A1 | * | 6/2003 | Lin | 297/344.18 X |

* cited by examiner

*Primary Examiner*—Rodney B. White
(74) *Attorney, Agent, or Firm*—B. Craig Killough

(57) ABSTRACT

A child's chair that may be readily adjusted with regard to the height of the seat bottom, and the position of the seat back relative to the seat bottom. The use of telescoping legs and a slidable support for the seat back allow the chair to be adjusted for positioning according to the needs of a particular child.

10 Claims, 5 Drawing Sheets

CHILD'S ADJUSTABLE CHAIR

RELATED APPLICATIONS

Applicant hereby claims the benefit of priority under Title 35 of the United States Code §119(e) of previously filed provisional patent application Ser. No. 60/408,128, filed Sep. 4, 2002.

FIELD OF THE INVENTION

This invention relates to seating devices generally, and is more specifically directed to a chair for a child that is adjustable with regard to seat height and back position.

BACKGROUND OF THE INVENTION

Learned studies acknowledge the importance of appropriate seating for children in classroom settings. Particular studies show that a child who is comfortably seated in a classroom environment will achieve a higher test score than a child who is not comfortably seated. Proper positioning while seated in classrooms and other educational settings is material to a child's ability to learn.

Most chairs commonly in use in classrooms are not easily adjustable. In a typical elementary school classroom, all, or nearly all, of the children will have the same type and size of chair or desk. At the same time, the height and weight of children within a particular grade in elementary school will vary substantially. A part from differences in height, the relative length of children's legs and torsos will vary substantially. However, with chairs and desks in common use, there is no ability to readily adjust the seating position.

The vast majority of schools, and in particular, public schools, operate under budgetary constraints that do not permit a substantial outlay of funds to acquire seating that positions each child according to his or her height, weight, or other ergonomic factors. A need exists for a chair that is adjustable, yet is structured so as to be affordable for use in classrooms and other educational settings.

SUMMARY OF THE PRESENT INVENTION

The present invention is a child's chair that may be readily adjusted with regard to the height of the seat bottom, and the position of the seat back relative to the seat bottom. The use of telescoping legs and a slidable support for the seat back allow the chair to be adjusted for positioning according to the needs of a particular child.

DESCRIPTION OF THE PREFERRED EMBODIMENT

Figure 1:
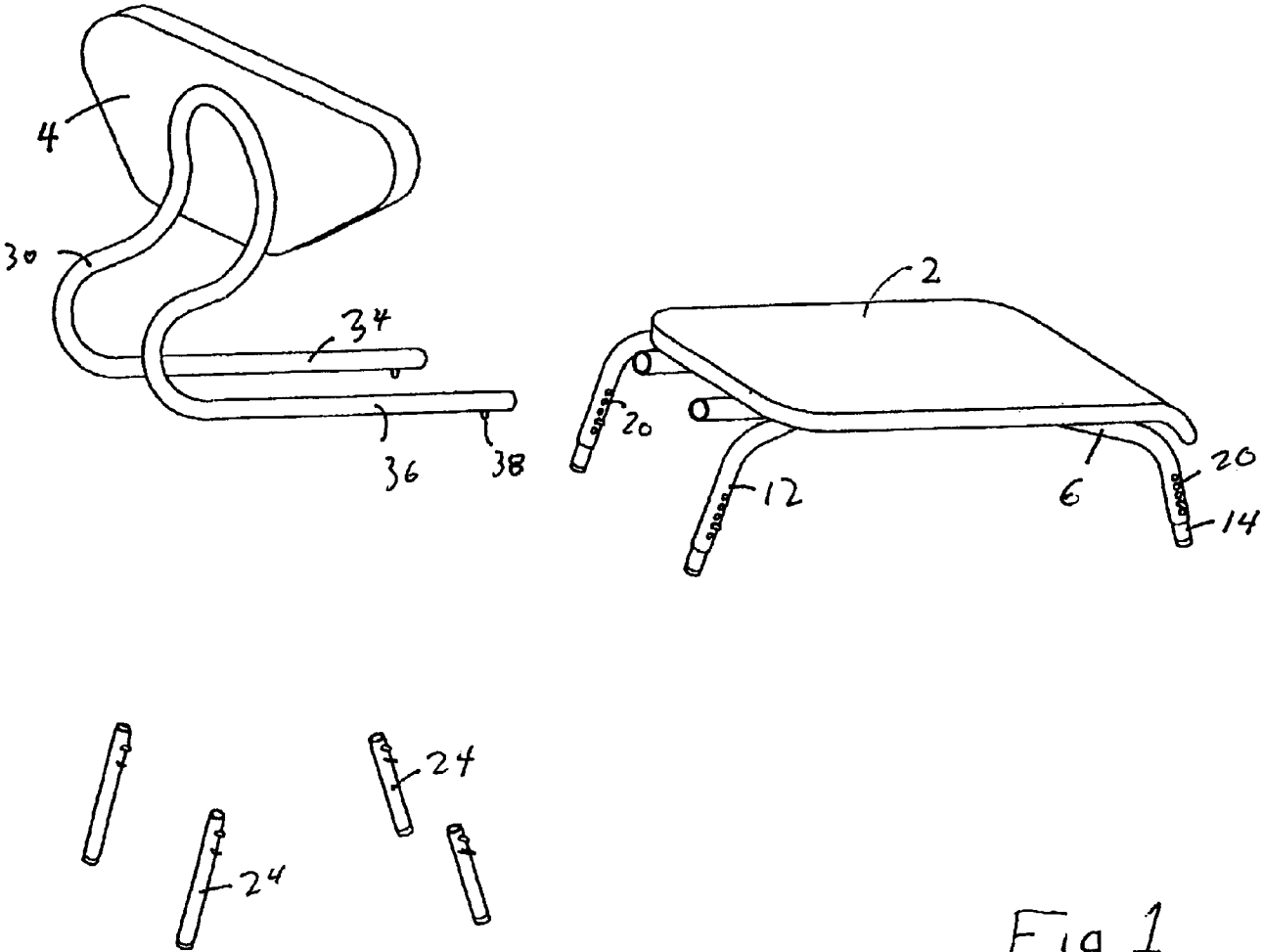
FIG. 1 is a perspective view of the chair, with two sets of legs shown, and with the seat back support exploded from the remainder of the chair.
Figure 2:
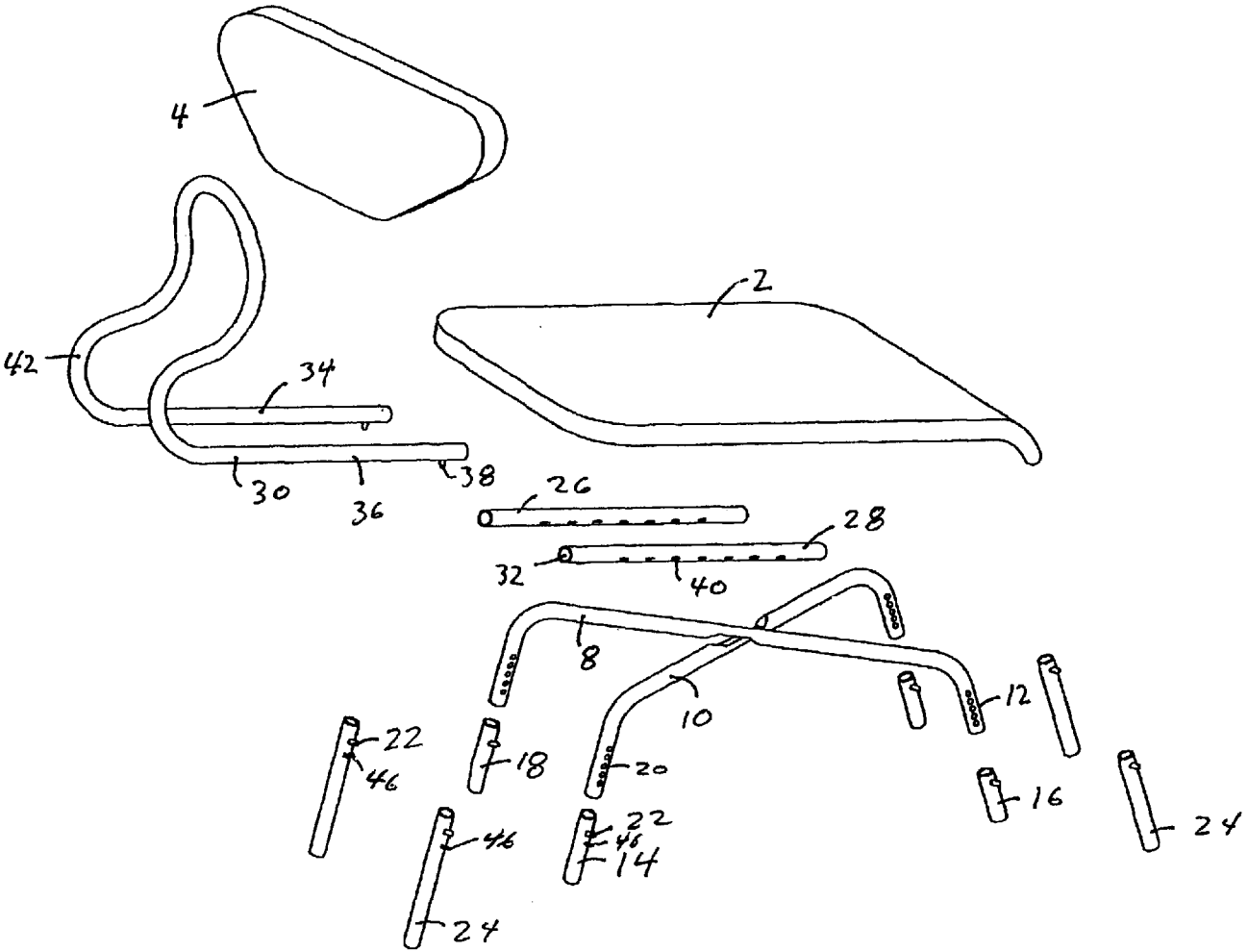
FIG. 2 is an exploded view of the chair, with two sets of legs shown.

Referring now to FIG. 1, the chair of the preferred embodiment has a seat bottom 2 and a seat back 4. A support member 6 supports the seat bottom. The support member is attached to a lower surface of the seat bottom. The support member may be comprised of two members 8, 10 that cross, as shown in FIG. 2. The support member has four downwardly extending portions 12, each of which comprises a part of one of the chair legs. The downwardly extending portions of the support member are spaced apart, with each present near the perimeter of the chair bottom, so as to support the chair in a stable manner.

In the preferred embodiment, each of the four downwardly turned portions of the support member receives a leg. Four legs 14 are positioned between the support member and the floor or other surface on which the chair is to rest. The front legs 16 are relatively shorter than the corresponding rear legs 18, as shown in the drawing figures. The legs are inserted into the support member, and accordingly, the support member has voids therein at the downwardly turned portions for receiving the legs.

The support member has a plurality of voids 20 formed therein. A spring loaded detent 22 is present in each of the legs. The detent engages a selected void from the plurality of voids, thereby retaining the leg within the void. The leg positioned with the detent in a void extends an appropriate length from the support member, as selected. The overall length of the telescoping legs is thereby varied as desired.

The position of the detent on the front legs is preferred to be the same for each of the front legs, so that the overall length of the legs formed by the support member and the front legs will be same when the legs are positioned in the same corresponding void. For example, when the detent is positioned in the second of the five voids as shown in FIG. 1, the front legs will have the same overall length. Similarly, the detents in the rear legs are positioned the same for each of the rear legs, so that when the detent is positioned in, for example, the second of the five detents, the overall height of the rear legs will be the same. It is also desired that when the detent is positioned in, for example, the second void of the five for each of the four legs, the overall length for each of the four legs is the same, and the seat bottom will be generally horizontal. In the preferred embodiment, the rear legs are relatively longer than the front legs, since the angle formed between the relatively horizontal portion of the support member and the downwardly turned portion of the support member is not the same.

An additional set of four legs 24 may be provided as shown in the drawing figures. The additional set of legs allows the chair to be used by taller children, since the additional set of legs is longer. The overall length of the legs formed between the support member and the additional legs is longer. Children of substantially different heights and having substantially different lengths of their legs may use the chair, and still be properly positioned. The additional set of legs has front legs that are of the same length and rear legs of the same length. Again, the detents are positioned so that when a particular void is selected for one of the front legs, the corresponding void for the remaining legs will yield legs of the same effective overall height.

In the preferred embodiment, the support member comprises a first generally horizontal member 26 and a second generally horizontal member 28. These horizontal members engage a back support member 30. The horizontal members mount to the remainder of the support member and to the seat bottom. Each of the horizontal members has an interior void 32 that receives a first generally horizontal portion 34 of the back support and a second generally horizontal portion 36 of the back support. The first generally horizontal portion of the back support and the second generally horizontal portion of the back support engage the first generally horizontal portion of the support member and the second generally horizontal portion of the support member. The generally horizontal portions of the back support member each have a detent 38 that selectively engages one of a plurality of voids 40 formed in the generally horizontal portion of the support member. The voids are positioned so that they are readily accessible from an underneath portion of the seat bottom for adjustment of the back support, which slideably engages the support member. The detents are spring loaded and may be selectively positioned in a selected void, thereby allowing the seat back to be moved horizontally, or along an x-axis, relative to the seat.

In the preferred embodiment, the back support extends upwardly from the generally horizontal portion of the seat back support on an end thereof that is opposite the engagement of the generally horizontal portion of the support member. The back support has an arcuate portion 42 which curves upwardly from the generally horizontal portion of the back support, and towards the seat bottom, and then curves upwardly again, so as to be generally at a right angle to the seat bottom. The seat back may have some curvature to fit the user's back, but is generally at a right angle to the seat bottom. The seat back is attached to, and supported by, the upper end of the back support.

The chair may be fabricated by bending tubing to form the support member, back support, and legs. Voids may be formed in the tubing as shown and spring loaded detents may be employed in the tubing as shown, as one skilled in the art will understand. The seat bottom may be attached to the support member by known means, such as rivets, carriage bolts or similar fasteners. The back support may be fastened to the seat back by fasteners such as rivets, carriage bolts or similar fasteners. The seat back or seat bottom may be molded plastic, fiberglass, wood or other suitable material.

An adjustable footrest may be attached to the front legs. The footrest may have a slidable attachment that allows the footrest to be moved upwardly or downwardly along the length of the legs, and fixed in place as desired. Referring now to FIG. 1, the chair of the preferred embodiment has a seat bottom and a seat back. The seat bottom is supported by a support member that is attached to a lower surface of the seat bottom. The support member may be comprised of two members which cross as shown in FIG. 1. The support member has four downwardly extending members each of which comprises a portion of the chair legs. The downwardly turned portion of the support members are preferred to be spaced a part, with each present near an outside portion of the chair so as to support the chair.

In the preferred embodiment, the forward downwardly turned portion of the support member receives a leg. The leg is positioned between the support member and the floor or other surface on which the chair is to rest. The front legs are relatively shorter than the corresponding rear legs as shown in the drawing figures. The legs are inserted into the support member, and accordingly, the support member has a void therein, at least at the down turned portion of the support member for receiving the legs. The support members have a plurality voids therein. A spring loaded detent which is present in the legs engages a selected void and retains the leg within void. The leg is positioned so as to extend an appropriate length from the support member, thereby allowing the overall length of the telescoping legs so formed, to be varied as desired. The position of the detent on the front legs is the same for each of the front legs, so that the overall length of the legs formed by the support member and the front legs will be the same when the legs are positioned in the same corresponding void. For example, when the detent is positioned in the third of the five voids as shown, the front legs will have the same overall length. Similarly, the detents in the rear legs are positioned the same for each of the rear legs, so that when the detent is positioned in, for example, the third of the five detents, the overall height of the rear legs will be the same. It is also desired that when the detent is positioned in, for example, the third void of the five voids as shown, for each of the four legs, that the overall length of each of the four legs is the same.

Figure 3:
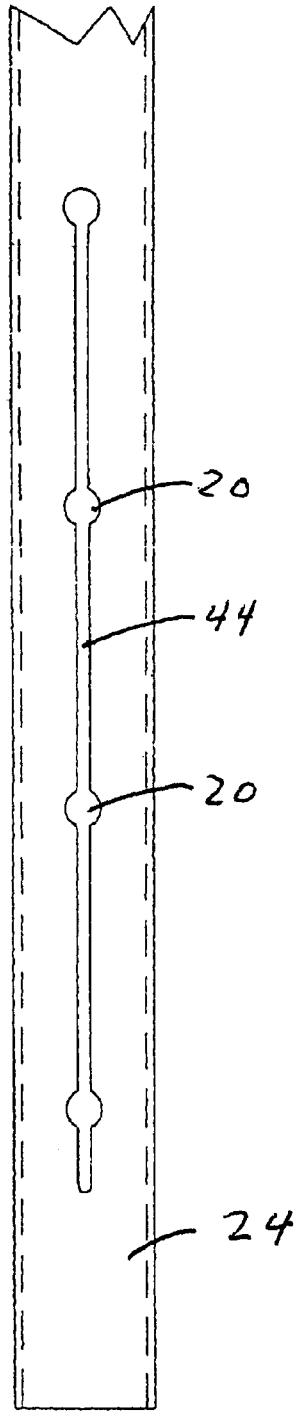
FIG. 3 is an isolation showing the adjustment slot in the support member.

FIG. 3 is an isolation of a portion of the downwardly extending portions of the support member, showing the voids 20 and a connecting slot 44 that communicates with the voids. A fixed pin 46 extends from the legs 14, 24 and engages, and traverses, the slot. Since the pin is fixed in the leg, unlike the detent, it prevents the leg from being easily removed by a student or other user, and potentially used as a weapon. The adjustment means described is preferred to allow the chair to be adjusted up to 18 inches in seating height.

The support for the seat back may use a similar slot to engage a pin in addition to the detent 38. The use of the arcuate back support allows the seat back to be moved inwardly past the seat, which is important for some students. The seat back travel is preferred to be at least 5 inches.

The rear legs are relatively longer than the front legs, since the angle formed between the relatively horizontal portion of the support member and the downwardly turned portion of the support member is not the same. The additional length of the rear legs provides the length needed. As additional set of legs may be provided as shown in the drawing figures. The additional set of legs allows the chair to be used for taller children, since the additional set of legs is longer, meaning that the overall length of the legs formed between the support member and the legs is longer. In this way, the chair may be used with children of substantially different heights and having substantially different lengths of their legs.

Figure 4:
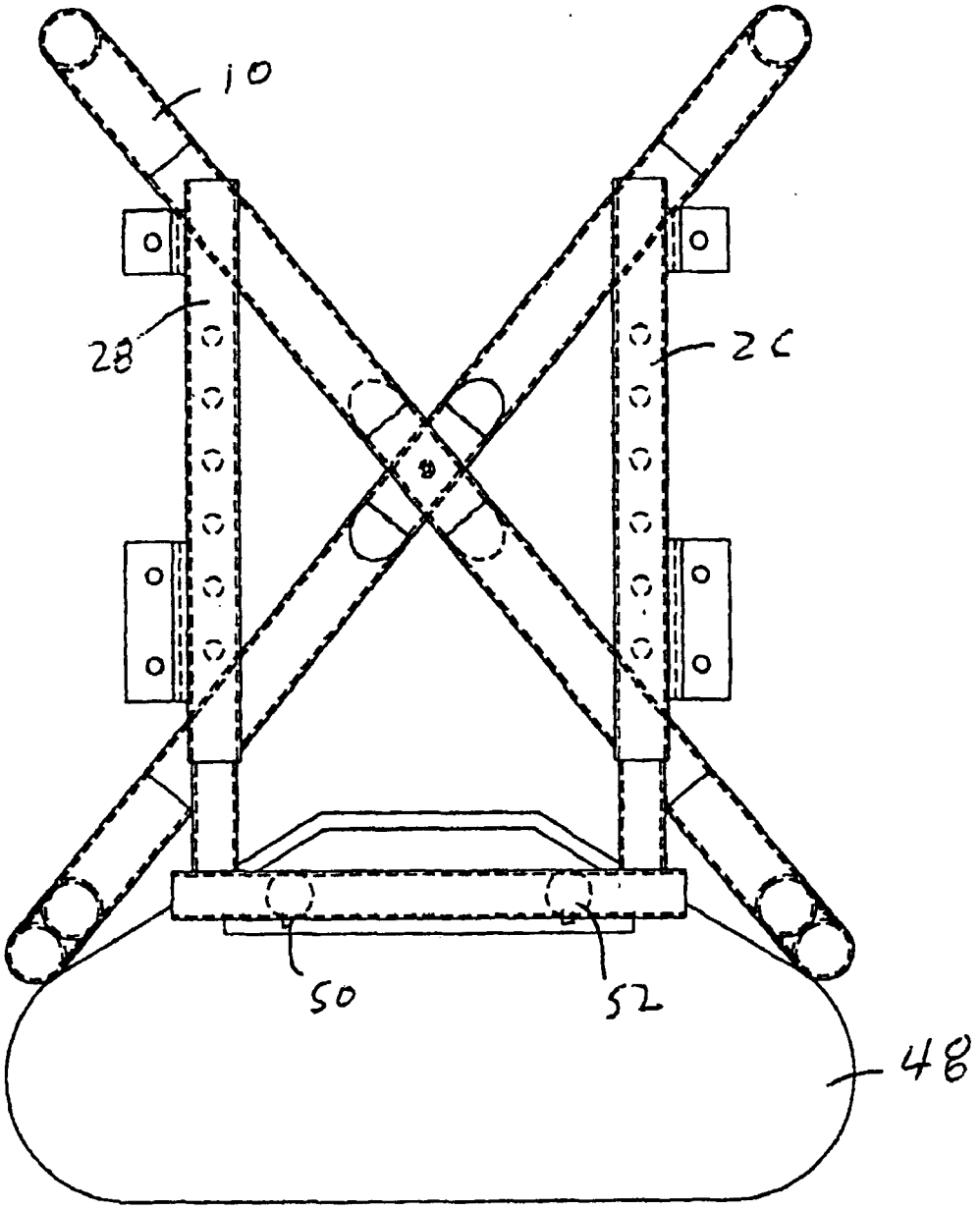
FIG. 4 is a top plan view isolating the support member with the footrest attached.
Figure 5:
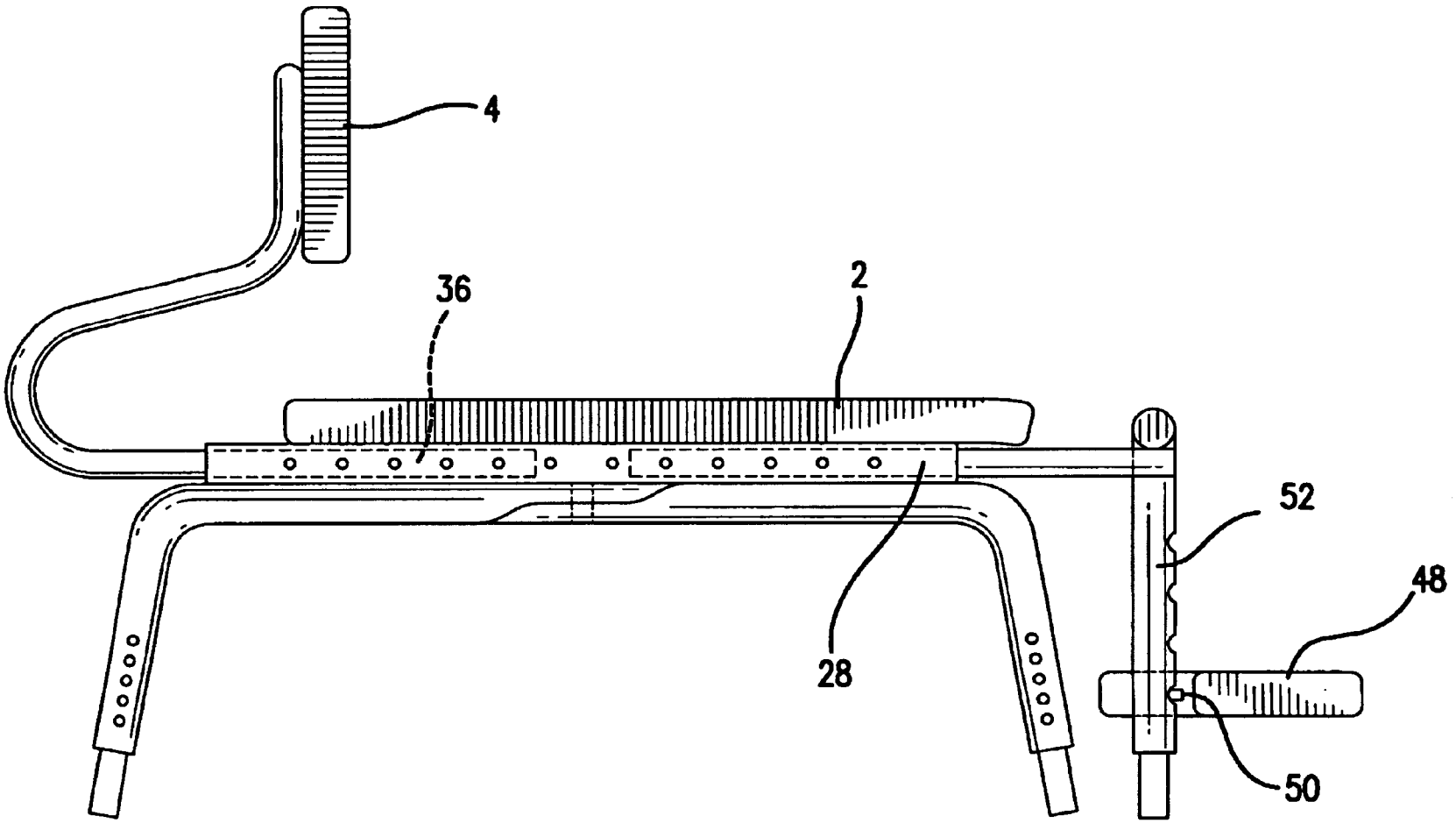
FIG. 5 is a side view of the chair showing the footrest attached.

The ability to adjust the height of the footrest is important to the invention, since it has been determined that seating comfort requires that the student's feet be positioned comfortably on the floor. Leg height adjustment alone may not achieve this goal for some students. The footrest 48 is attached to the front of the chair at the first generally horizontal member 26 and a second generally horizontal member 28. FIG. 4. The footrest uses a telescoping system similar to that for the legs to allow the footrest to be moved upwardly or downwardly relative to the remainder of the chair. Detents 50 engage voids in the telescoping and generally vertical supports 52, and pins may traverse slots, to provide upward and downward travel and interval positioning of the footrest, as described above for the legs.

What is claimed is:

1. An adjustable child's chair, comprising:

a seat bottom;

a support member;

at least four legs extending downwardly and below said seat bottom;

a back support that slidably engages said support member, wherein said back support is movable horizontally relative to said seat bottom by slidable engagement with said support member; and a seat back that is mounted to said back support and moves horizontally relative to said seat bottom and with said back support, wherein said seat back is movable horizontally to a position wherein said seat back is directly above said seat bottom.

2. An adjustable child's chair, comprising:

a seat bottom;

a support member;

at least four legs extending downwardly and below said seat bottom;

a back support that slidably engages said support member, wherein said back support is movable horizontally relative to said seat bottom by slidable engagement with said support member; and a seat back that is mounted to said back support and moves horizontally relative to said seat bottom and with said back support;

wherein a portion of said back support extends generally horizontally from said support member, and said seat back is connected to an end of said back support that is above an arcuate portion of said back support that extends away from said seat back and opposite said seat bottom, wherein said back support permits said seat back to be positioned directly above said seat bottom by said slidable engagement with said support member.

3. An adjustable child's chair as described in claim 2, further comprising a footrest that is present on said adjustable child's chair forward of said seat bottom, wherein said footrest is capable of vertical movement relative to said chair bottom.

4. An adjustable child's chair as described in claim 2, wherein a usable length of said at least four legs is adjustable.

5. An adjustable child's chair as described in claim 2 wherein at least a portion of said arcuate portion of said back support that extends away from said seat back and opposite said seat bottom is not present directly below said seat back.

6. An adjustable child's chair, comprising:

a seat bottom;

a support member positioned below said seat bottom and supporting said seat bottom;

at least four telescoping legs extending downwardly from said support member; a back support that slidably engages said support member, and extends generally horizontally from said support member at a lower portion of said support member, said back support having an upper end that extends upwardly from said lower portion of said support member; and a seat back that is mounted to said upper end of said back support;

wherein a portion of said back support that extends generally horizontally from said support member at said lower portion of said support member is connected to said upper end that extends upwardly from said lower portion of said support member by an arcuate portion of said back support that curves away from said seat bottom, and wherein said back support and wherein said back support is slidably adjustable and permits said seat back to be slidably positioned directly over said seat bottom at some selected positions.

7. An adjustable child's chair as described in claim 6, wherein said support member has at least four downwardly extending members, each of said downwardly extending members comprising a plurality of general vertically spaced apart voids, and wherein each said telescoping legs has a displaceable detent that selectively engages one of said vertically spaced apart voids, and wherein each of said downwardly extending members comprises a slot that extends between each of said vertically spaced apart voids, wherein a width of said slot is less than a diameter of said voids, and wherein each of said telescoping legs has a fixed pin therein that engages said slot.

8. An adjustable child's chair, comprising:

a seat bottom;

a support member positioned below said seat bottom and supporting said seat bottom;

at least four legs extending downwardly from said support member, said legs comprising means for selectively positioning said legs upwardly and downwardly relative to said support member;

a back support having means for selectively horizontally positioning said back support relative to said seat bottom; and a seat back that is mounted to an upper end of said back support, wherein a portion of said back support extends horizontally from said support member at a lower portion of said support member and said seat back is connected to an upper end of said back support above an arcuate portion of said back support that curves away from said seat back and opposite said seat bottom, wherein said back support permits all of said seat back to be positioned directly above said seat bottom by said means for selectively horizontally positioning said back support relative to said support member.

9. An adjustable child's chair as described in claim 2, further comprising a footrest that is present on said adjustable child's chair forward of said seat bottom, wherein said footrest is capable of vertical movement relative to said chair bottom.

10. An adjustable child's chair as described in claim 1, wherein a useable length of said at least four legs is adjustable.

* * * * *